US011000073B2

(12) United States Patent
Hu et al.

(10) Patent No.: US 11,000,073 B2
(45) Date of Patent: May 11, 2021

(54) AEROSOL GENERATING DEVICE CAPABLE OF ADJUSTING HEATING AREA

(71) Applicant: SHENZHEN FIRST UNION TECHNOLOGY CO., LTD., Shenzhen (CN)

(72) Inventors: Jie Hu, Shenzhen (CN); Yonghai Li, Shenzhen (CN); Zhongli Xu, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 408 days.

(21) Appl. No.: 16/172,918

(22) Filed: Oct. 29, 2018

(65) Prior Publication Data

US 2019/0124988 A1 May 2, 2019

(30) Foreign Application Priority Data

Oct. 30, 2017 (CN) ..... 201721415005.6

(51) Int. Cl.

| | |
|---|---|
| ***A24F 47/00*** | (2020.01) |
| ***H05B 6/36*** | (2006.01) |
| ***A24F 40/465*** | (2020.01) |
| ***H05B 6/06*** | (2006.01) |

(52) U.S. Cl.

CPC ..... *A24F 47/008* (2013.01); *A24F 40/465* (2020.01); *H05B 6/06* (2013.01); *H05B 6/36* (2013.01)

(58) Field of Classification Search

CPC ..... A24F 40/465; A24F 47/008; H05B 6/02; H05B 6/06

See application file for complete search history.

(56) References Cited

U.S. PATENT DOCUMENTS

| | | | | |
|---|---|---|---|---|
| 2004/0005176 | A1 | 1/2004 | Yokozeki | |
| 2017/0055580 | A1 | 3/2017 | Blandino et al. | |
| 2017/0055584 | A1 | 3/2017 | Blandino et al. | |
| 2017/0119054 | A1 * | 5/2017 | Zinovik | H05B 6/105 |
| 2017/0172215 | A1 | 6/2017 | Li et al. | |

FOREIGN PATENT DOCUMENTS

| | | | |
|---|---|---|---|
| CN | 203762294 | U | 8/2014 |
| CN | 204191584 | U | 3/2015 |
| CN | 104095291 | B | 1/2017 |
| JP | 2002075608 | A | 3/2002 |

OTHER PUBLICATIONS

European Search Report, dated Mar. 29, 2019.

* cited by examiner

*Primary Examiner* — Eric Yaary
(74) *Attorney, Agent, or Firm* — IPro, PLLC

(57) ABSTRACT

An aerosol generating device includes a device main body defining a heating chamber for accommodating an aerosol generating material, a heating element made of a metal material and mounted in the heating chamber, an induction coil configured to generate an alternating magnetic field and positioned around the periphery of the heating element, a power supply connected with the induction coil to form an electrical circuit, and an adjusting element for changing a length of the induction coil which is connected into the electrical circuit, so that at least overlapping portion of the heating element corresponding to the induction coil of this length internally generates eddy currents and heats the aerosol generating material.

8 Claims, 4 Drawing Sheets

AEROSOL GENERATING DEVICE CAPABLE OF ADJUSTING HEATING AREA

CROSS-REFERENCE TO RELATED APPLICATIONS

The present disclosure claims priority to Chinese Patent Application No. 201721415005.6 filed with the Chinese Patent Office on Oct. 30, 2017, titled "AEROSOL GENERATING DEVICE CAPABLE OF ADJUSTING HEATING AREA", the entire contents of which are incorporated herein by reference.

TECHNICAL FIELD

The disclosure relates to the field of electronic cigarettes, and in particular, relates to an aerosol generating device capable of adjusting heating area.

BACKGROUND

At present, heating schemes of low-temperature smoking sets on the market are to adopt a heating element with a fixed length, so that a heating area formed during the working process of the heating element is substantially unchanged. However, the length of an aerosol generating material to be heated (taking a tobacco material as an example) often does not match the length of the heating element. The heating area of the heating element cannot cover the entire length of the tobacco material, and only a partial length of the tobacco material can be heated to generate an aerosol. As a result, the heating area of the existing heating element is not uniform relative to the tobacco material, which may easily lead to uneven heating of the tobacco, so that the tobacco in some areas is not heated sufficiently, and the experience effect is affected.

SUMMARY

The disclosure provides an aerosol generating device capable of adjusting heating area. The aerosol generating device includes a device main body, a heating element made of a metal material, an induction coil for generating an alternating magnetic field, a power supply, and an adjusting element, wherein, the device main body internally defines a heating chamber for accommodating an aerosol generating material; the heating element is mounted in the heating chamber; the induction coil is positioned around the periphery of the heating element; the power supply is connected with the induction coil to form an electrical circuit; and the adjusting element is configured to change a length of the induction coil which is connected into the electrical circuit, so that at least overlapping portion of the heating element corresponding to the induction coil of this length internally generates eddy currents and heats the aerosol generating material.

In one of the embodiments, the adjusting element includes a slider, the slider includes a sliding contact in electrical contact with the induction coil, a pole of the power supply is connected to the sliding contact, and the other pole of the power supply is connected to one end of the induction coil.

Specifically, the slider also includes a slide switch connected to the sliding contact, and the device main body axially defines a sliding groove for the slide switch to axially slide.

In another embodiment, the adjusting element includes a gear switch, the induction coil includes a plurality of electrical connection points spaced in the length direction, and the electrical connection points are connected to the power supply through the gear switch, and the gear switch is configured to switch different electrical connection points to change the length of the induction coil which is connected into the electrical circuit.

In one of the embodiments, the heating element is located at the center of the heating chamber, and the heating element is a metal sheet or a metal rod that can be inserted into the aerosol generating material.

In another embodiment, the heating element is a metal sleeve positioned on an inner wall of the heating chamber and capable of surrounding the aerosol generating material.

In a specific embodiment of the disclosure, the aerosol generating material is a cigarette containing a tobacco material, the device main body includes a heating sleeve having an opening on its upper end, the heating chamber is defined in the heating sleeve, and the opening is configured to allow the cigarette to be inserted into the heating chamber.

Further, a framework for fixing the induction coil is mounted on the periphery of the heating sleeve and the framework is made of a heat insulating material.

DETAILED DESCRIPTION

In order to facilitate the understanding of the disclosure, the structure and function principle of an aerosol generating device capable of adjusting heating area according to the disclosure will be further described below with specific embodiments. It should be noted that when an element is referred to as "being fixed to" another element, it can be directly on the other element or one or more intermediate elements may exist between the two; when an element is referred to as "being connected to" another element, the element can be directly connected to another element or one or more intermediate elements may exist between the two.

Figure 1:
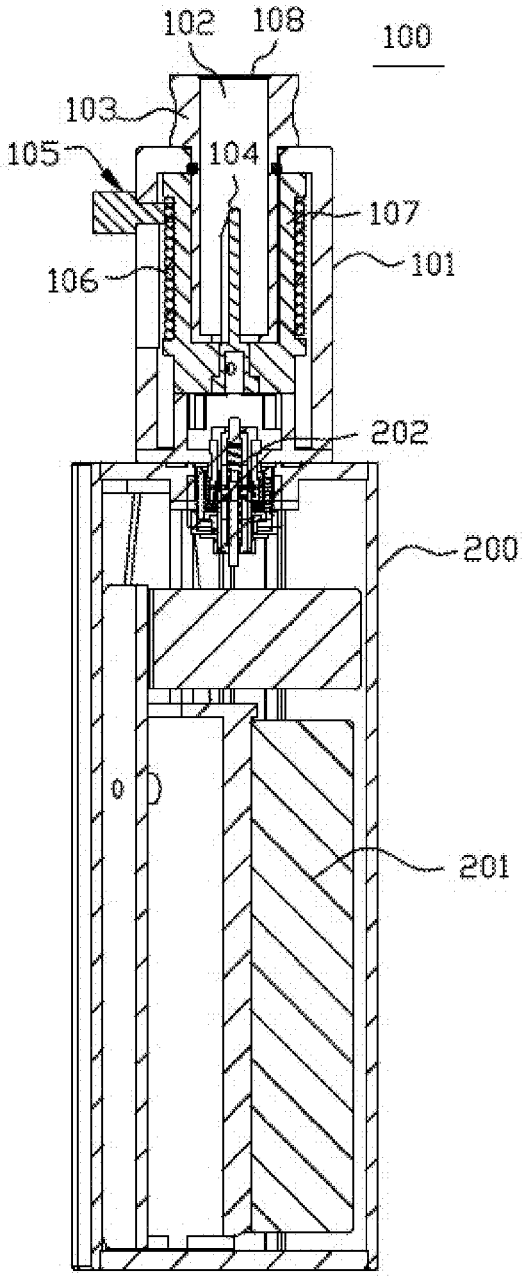
FIG. 1 is an axial cross-sectional view of an aerosol generating device according to an embodiment provided by the disclosure.

Referring to FIG. 1, an embodiment of the disclosure provides an aerosol generating device 100 capable of adjusting heating area. The aerosol generating device 100 includes a device main body 101, a heating element 104 located in the device main body 101, an induction coil 106, and an adjusting element. The device main body 101 internally defines a heating chamber 102 for accommodating an aerosol generating material. The heating element 104 is made of a metal material, such as an iron-cobalt alloy, and the heating element 104 is located in the heating chamber 102 and configured to heat the aerosol generating material to generate an aerosol for a user to suck out.

Figure 2:
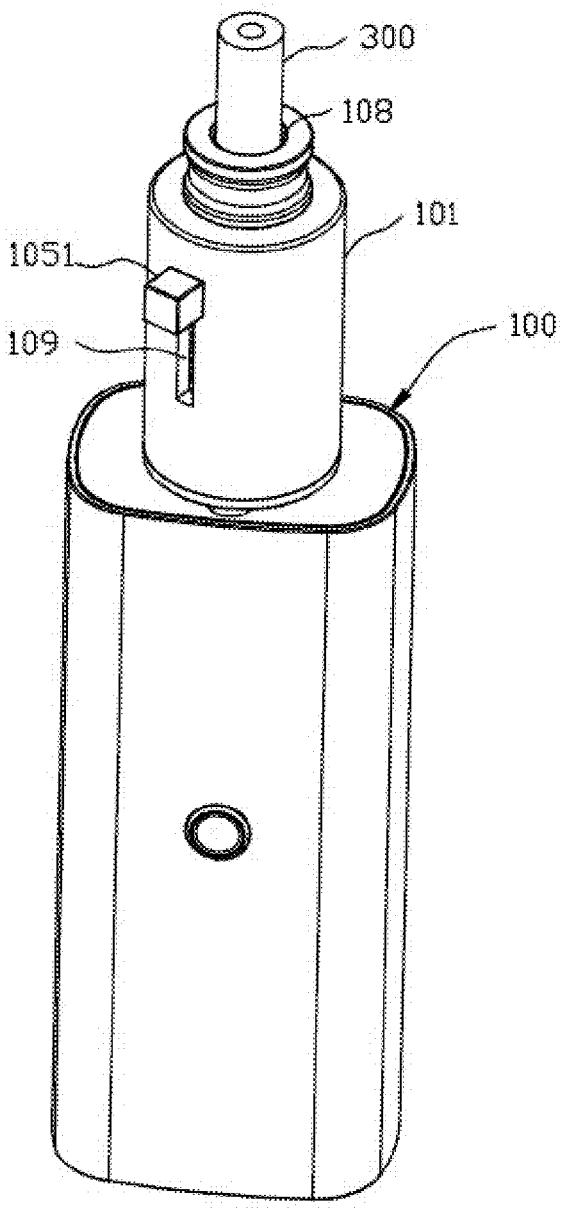
FIG. 2 is a schematic view showing a state in which a cigarette is placed in an aerosol generating device according to an embodiment.

Referring to FIG. 2, specifically in this embodiment, the aerosol generating material is a cigarette 300 containing a tobacco material, and the device main body 100 includes a heating sleeve 103 having an opening 108 on its upper end. The heating chamber 102 is defined in the heating sleeve 103, and the opening 108 is configured to allow the cigarette 300 to be inserted into the heating chamber 102. The tobacco material is heated to generate an aerosol containing particles of volatile tobacco ingredients, and the user sucks the aerosol out through a suction nozzle end of the cigarette 300. It should be noted that the aerosol generating material may also be a material that can be inhaled, such as smoke paste, a volatile material containing pharmaceutical ingredients, or a flavoring agent.

It may be understood that the aforementioned heating chamber 102 may also be of a closed structure, an end cover with a suction nozzle can be positioned at the opening position of the heating chamber, and the user can add the tobacco material into the heating chamber 102 by opening the end cover.

Further, a framework 107 for fixing the induction coil 106 is mounted on the periphery of the heating sleeve 103, and the framework 107 is made of a heat insulating material to prevent the overheating temperature of the heating element 104 from being conducted outward to damage the induction coil 106 or cause a housing to be hot.

The aforementioned induction coil 106 is positioned around the periphery of the heating element 104 and configured to generate an alternating magnetic field to generate eddy currents and heat inside the heating element 104 in the magnetic field. The induction coil 106 is connected to the power supply 200 and forms an electrical circuit. In the axial direction, the induction coil 106 can substantially cover the length of the heating element 104, and the adjusting element is configured to change the length of the induction coil 106 which is connected into the electrical circuit, so that at least overlapping portion of the heating element 104 corresponding to the induction coil 106 of this length internally generates eddy currents, and the heating element 104 generates heat in the partial length or generates heat integrally, thereby implementing the free adjustment of the heat generation of the heating element 104 in the partial length area. In a specific practical situation, the aerosol generating device 100 provided in this embodiment can also be applied to different length specifications of the tobacco material segment of the cigarette, thereby improving universality.

Figure 3:
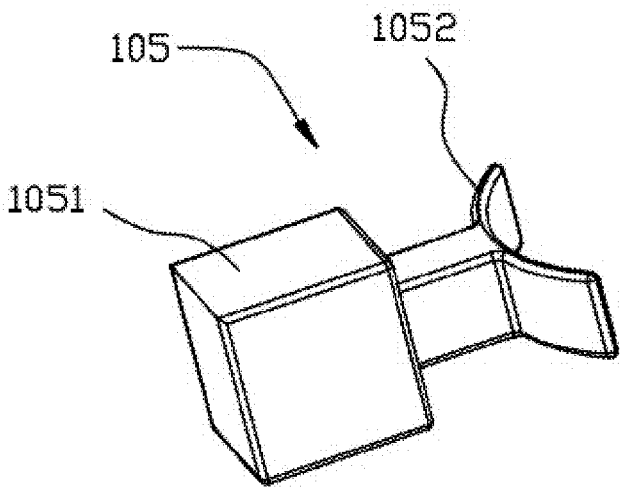
FIG. 3 is a schematic structural view of a slider according to an embodiment.

As shown in FIG. 2 and FIG. 3, as one of the embodiments of the adjusting element, the adjusting element includes a slider 105, and the slider 105 includes a sliding contact 1052 in electrical contact with the induction coil 106. The power supply 200 includes an internal battery 201, a circuit board, and an electrode connecting piece 202. One pole of the electrode connecting piece 202 is electrically connected to the sliding contact 1052 through a wire or a structural element, and the other pole of the electrode connecting piece 202 is connected with one end of the induction coil 106. When the sliding contact 1052 of the slider 105 slides up and down, the sliding contact 1052 is always in electrical contact with the induction coil 106, so that the length of the induction coil 106 in the electrical circuit can be changed. When the aerosol generating device 100 is in operation, the user can adjust the working length of the induction coil 106 by moving the slider 105 to increase the temperature of portion of the heating element 104 in the corresponding length, thereby achieving partial heating of the tobacco material. When the slider 105 is moved to the upper end of the induction coil 106, the induction coil 106 covers the entire length of the heating element 104, thus simultaneous heating of the tobacco material as a whole can be achieved.

Referring to FIG. 2, the slider 105 also includes a slide switch 1051 connected to the sliding contact 1052, and the device main body 101 axially defines a sliding groove 109 for the slide switch 1051 to axially slide. Obviously, the slide switch 1051 can also change the position of the sliding contact 1052 by using a switch such as a knob or a toggle switch.

In this embodiment, the heating element 104 is located at the center of the heating chamber 102, and the heating element 102 is a metal sheet or a metal rod that can be inserted into the aerosol generating material. The metal sheet or the metal rod generates heat and heats the aerosol generating material from the center to the periphery.

Figure 4:
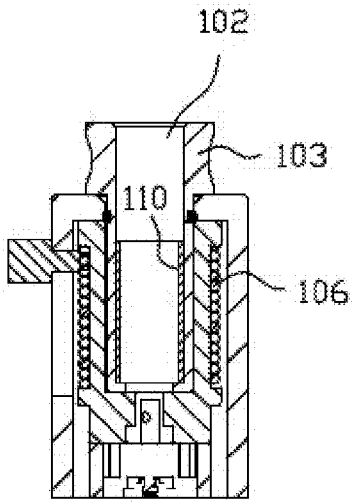
FIG. 4 is a schematic structural view of a heating element which is a metal sleeve according to another embodiment.

Referring to FIG. 4, in another embodiment, the heating element may also be a metal sleeve 110 positioned on an inner wall of the heating chamber 102 and surrounding the aerosol generating material, and the induction coil 106 is also located on the periphery of the metal sleeve 110. The metal sleeve 110 heats the aerosol generating material from the periphery to the center.

Figure 5:
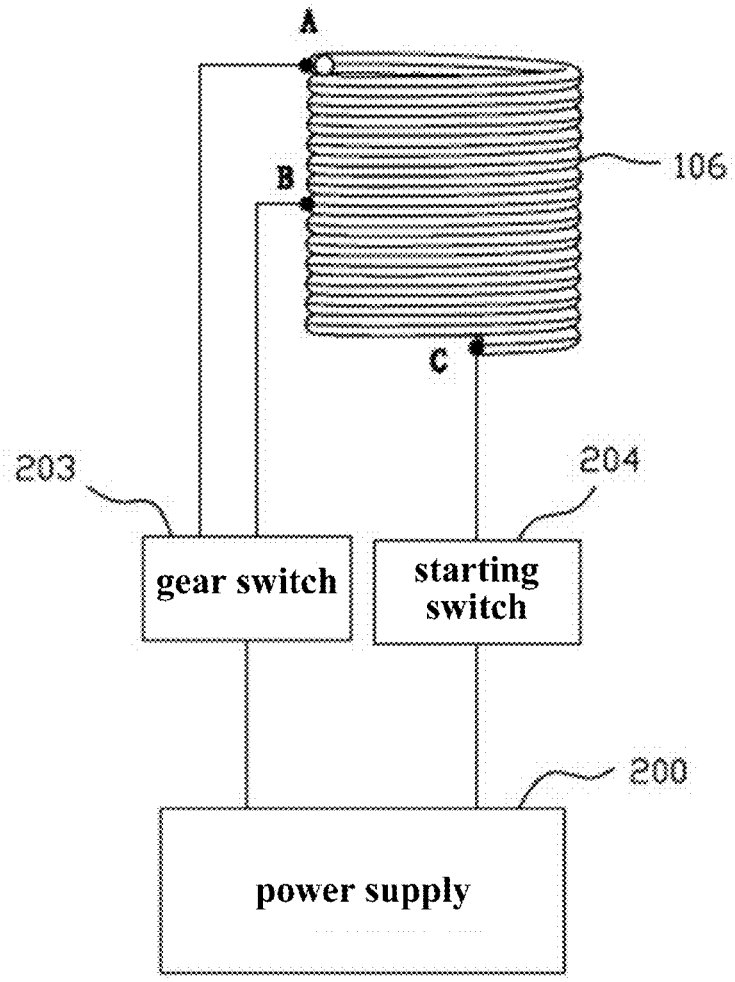
FIG. 5 is a schematic view of an adjusting element being a gear switch according to another embodiment.

Referring to FIG. 5, the disclosure also provides another embodiment of the aforementioned adjusting element. The adjusting element includes a gear switch 203, and the gear switch 203 can be positioned on the power supply 200. The induction coil 106 includes a plurality of electrical connection points spaced in the length direction, the electrical connection points are connected to the power supply 200 through the gear switch 203, and the gear switch 203 is configured to switch different electrical connection points to change the length of the induction coil 106 which is connected into the electrical circuit. For example, the electrical connection points A, B, and C are sequentially positioned at both ends and the center of the induction coil 106 in the length direction, the electrical connection points A and B are connected to one pole of the power supply 200 through the gear switch 203, and the electrical connection point C is connected with the other pole of the power supply 200 through a starting switch 204. When the starting switch 204 is turned on, the induction coil 106 is energized and the heating element 104 starts to work, and when the gear switch 203 is switched to the electrical connection point B, only the lower partial induction coil 106 is energized; and when the gear switch 203 is switched to the electrical connection point A, the entire induction coil 106 is energized.

Through the solutions of implementing electromagnetic induction heating of a portion of the heating element 104 by adjusting the induction coil 106 in the above embodiments, not only the partial area of the cigarette 300 can be heated, but also the whole cigarette 300 can be heated, so that the cigarette 300 is sufficiently heated in the length direction, and the overall utilization rate of the cigarette 300 and the user's consumption experience can be obviously improved.

The above embodiments are merely some of the embodiments for easily understanding of the disclosure, and are not intended to limit the technical solutions of the disclosure, and are not exhaustive of all the embodiments. Any minor improvements or equivalent substitutions made on the structure, processes or steps of the disclosure should fall within the protective scope of this disclosure.

What is claimed is:

1. An aerosol generating device capable of adjusting heating area, comprising: a device main body, the device main body internally defining a heating chamber for accommodating an aerosol generating material;

a heating element made of a metal material and mounted in the heating chamber; an induction coil configured to generate an alternating magnetic field and positioned around the periphery of the heating element;

a power supply which is connected with the induction coil to form an electrical circuit;

wherein a physical length of the induction coil, a length which extends around the periphery of the heating element, is fixed; and the device further comprises an adjusting element configured to change an electrical length of the induction coil, a length which is connected into the electrical circuit, so that at least a portion of the heating element corresponding to and overlapping the induction coil of this electrical length internally generates eddy currents and heat.

2. The aerosol generating device according to claim 1, wherein the adjusting element comprises a slider, the slider comprises a sliding contact in electrical contact with the induction coil, a pole of the power supply is connected to the sliding contact, and the other pole of the power supply is connected to one end of the induction coil.

3. The aerosol generating device according to claim 2, wherein the slider further comprises a slide switch connected to the sliding contact, and the device main body axially defines a sliding groove for the slide switch to axially slide.

4. The aerosol generating device according to claim 1, wherein the adjusting element comprises a gear switch, the induction coil comprises a plurality of electrical connection points spaced in the length direction, and the electrical connection points are connected to the power supply through the gear switch, and the gear switch is configured to switch different electrical connection points to change the length of the induction coil which is connected into the electrical circuit.

5. The aerosol generating device according to claim 1, wherein the heating element is located at the center of the heating chamber, and the heating element is a metal sheet or a metal rod that can be inserted into the aerosol generating material.

6. The aerosol generating device according to claim 1, wherein the heating element is a metal sleeve positioned on an inner wall of the heating chamber and capable of surrounding the aerosol generating material.

7. The aerosol generating device according to claim 1, wherein the aerosol generating material is a cigarette containing a tobacco material, the device main body comprises a heating sleeve having an opening on its upper end, the heating chamber is defined in the heating sleeve, and the opening is configured to allow the cigarette to be inserted into the heating chamber.

8. The aerosol generating device according to claim 7, wherein a framework for fixing the induction coil is mounted on the periphery of the heating sleeve, and the framework is made of a heat insulating material.

* * * * *